US008967104B2

(12) United States Patent
Dietz

(10) Patent No.: US 8,967,104 B2
(45) Date of Patent: Mar. 3, 2015

(54) CAMSHAFT ADJUSTER

(75) Inventor: Joachim Dietz, Frensdorf (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 405 days.

(21) Appl. No.: 13/059,696

(22) PCT Filed: Jul. 21, 2009

(86) PCT No.: PCT/EP2009/059371

§ 371 (c)(1),
(2), (4) Date: Feb. 18, 2011

(87) PCT Pub. No.: WO2010/020507

PCT Pub. Date: Feb. 25, 2010

(65) Prior Publication Data

US 2011/0139101 A1 Jun. 16, 2011

(30) Foreign Application Priority Data

Aug. 21, 2008 (DE) ..... 10 2008 039 038

(51) Int. Cl.

| | |
|---|---|
| ***F01L 1/34*** | (2006.01) |
| ***F01L 1/04*** | (2006.01) |
| ***F01L 1/02*** | (2006.01) |
| ***F01L 1/047*** | (2006.01) |
| *F01L 1/344* | (2006.01) |

(52) U.S. Cl.

CPC . *F01L 1/34* (2013.01); *F01L 1/047* (2013.01); *F01L 2001/0476* (2013.01); *F01L 2001/34426* (2013.01); *F01L 2001/34433* (2013.01)

USPC ..... 123/90.17; 123/90.15; 123/90.6; 123/90.31

(58) Field of Classification Search

CPC ..... F01L 1/02; F01L 1/022; F01L 1/024; F01L 1/34; F01L 1/344; F01L 1/3442; F01L 1/047

USPC ..... 123/90.17, 90.15, 90.31

See application file for complete search history.

(56) References Cited

U.S. PATENT DOCUMENTS

| | | | | |
|---|---|---|---|---|
| 3,063,306 | A * | 11/1962 | Jeffrey | 74/568 R |
| 4,494,496 | A * | 1/1985 | Nakamura et al. | 123/90.15 |
| 4,535,731 | A * | 8/1985 | Banfi | 123/90.15 |
| 5,088,456 | A * | 2/1992 | Suga | 123/90.17 |
| 5,934,234 | A * | 8/1999 | Shichinohe et al. | 123/90.31 |
| 6,026,772 | A | 2/2000 | Shirabe | |
| 6,363,896 | B1 * | 4/2002 | Speier | 123/90.17 |
| 6,691,024 | B2 * | 2/2004 | Kunz | 701/114 |
| 2008/0173128 | A1 * | 7/2008 | Vogel et al. | 74/567 |

FOREIGN PATENT DOCUMENTS

| | | | |
|---|---|---|---|
| DE | 41 02 753 | A1 | 8/1991 |
| DE | 197 52 381 | A1 | 5/1999 |
| DE | 198 17 319 | A1 | 10/1999 |
| DE | 100 02 512 | A1 | 7/2001 |
| DE | 101 34 320 | A1 | 1/2003 |

(Continued)

*Primary Examiner* — Christopher Jetton
*Assistant Examiner* — Daniel Wagnitz
(74) *Attorney, Agent, or Firm* — Davison, Davidson & Kappel, LLC

(57) ABSTRACT

A camshaft adjuster for adjusting the phase position of a camshaft relative to a crankshaft, in particular a hydraulic camshaft adjuster. A camshaft bearing area provided in the camshaft adjuster is designed as a roller bearing.

9 Claims, 1 Drawing Sheet

(56) References Cited

FOREIGN PATENT DOCUMENTS

| | | | |
|---|---|---|---|
| DE | 10 2004 053 572 | A1 | 6/2005 |
| DE | 10 2006 036 851 | A1 | 6/2007 |
| DE | 10 2005 059 841 | A1 | 7/2007 |
| EP | 1 178 185 | A | 2/2002 |
| WO | 2007016913 | A2 | 2/2007 |
| WO | 2007068586 | A1 | 6/2007 |

* cited by examiner

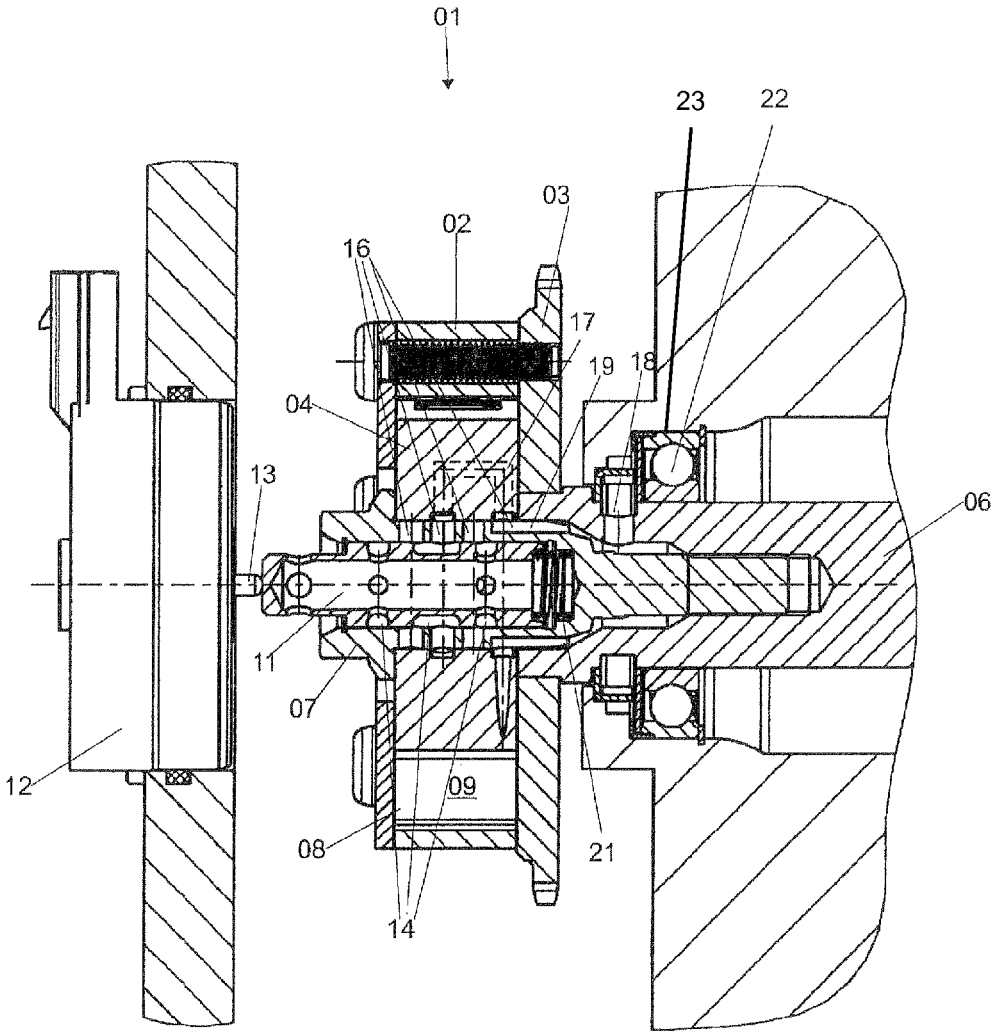
01
23
22
03
02
16
17
19
18
04
13
06
11
07
12
09
08
21
14

CAMSHAFT ADJUSTER

This application is a 371 of PCT/EP2009/059371 filed Jul. 21, 2009, which in turn claims the priority of DE 10 2008 039 038.0 filed Aug. 21, 2008, the priority of both applications is hereby claimed and both applications are incorporated by reference herein.

FIELD OF THE INVENTION

The invention relates to a camshaft adjuster of an internal combustion engine, in particular a hydraulic camshaft adjuster.

BACKGROUND OF THE INVENTION

Nowadays, use is widely made of the hydraulic phase or camshaft adjuster, having an oscillating or rotary motor known from the field of hydraulics. Said oscillating motor phase adjuster is operated with engine oil pressure. The phase adjuster is conventionally situated on the ends of the camshaft in the power transmission path. The hydraulic camshaft adjuster is supplied with pressurized oil by means of the oil pump of the engine, Oil guiding ducts are provided in the camshaft for the supply to the actuator. By means of electronically controlled valves, the hydraulic oil is conveyed into the oil pressure chambers of the oscillating motor, and an adjustment of the phase position of the camshaft relative to the crankshaft is thereby attained. That side of the camshaft which faces toward the camshaft adjuster is mounted in a plain bearing on account of the hydraulic oil supply which is usually conducted through the camshaft. For the mounting of the camshaft at the end side, use is usually made of bushes or bearing blocks.

DE 100 02 512 A1 describes a cylinder head for a valve-controlled internal combustion engine, in which cylinder head are provided bearing seats for the inlet and outlet camshafts. On the side of the hydraulic camshaft adjuster, a bearing bush is provided in the bearing seat in order to compensate for the assembly recesses required in the bearing seat and to permit the supply of hydraulic oil to the camshaft adjuster in the bearing point. The hearing bush has two openings, which are arranged axially adjacent to one another, for the two-duct supply of oil to the camshaft adjuster, and a lubricant opening for the lubrication of the bearing point.

DE 10 2004 053 572 B4 describes a hydraulic camshaft adjuster having a two-duct oil guide in the camshaft. Two oil guiding ducts are provided within the camshaft, via which oil guiding ducts hydraulic oil is supplied to in each case one oil pressure chamber (depending on the desired adjusting direction). The oil guiding ducts extend through the camshaft and via external lines to an oil pump and an oil control valve.

DE 198 17 319 A1 describes a hydraulic camshaft adjuster in which a central control slide is provided in order to supply hydraulic oil to the working chambers of the vane-type adjuster. The central control slide replaces the external valve and is integrated, as a 4/2 directional control valve, into the central fastening screw for the camshaft, as a result of which only one radial oil guiding duct is required in the camshaft, and the axial structural length of the camshaft adjuster is reduced.

Various documents, such as for example DE 10 2005 059 841 A1 or DE 197 52 381 A1, are concerned inter alia with the lubrication of bearing points for camshafts.

Depending on the rotational speed range of the engine and the temperature, mechanical friction losses in the engine alone nowadays amount to up to 30 percent, and therefore account for a significant proportion of fuel consumption. The main sources of friction losses in the engine are the piston assemblies, the bearings of the engine shafts, and the valve drive components.

It is therefore the object of the invention to optimize a camshaft bearing point at the side of a hydraulic camshaft adjuster with regard to the occurring friction losses.

SUMMARY OF THE INVENTION

According to the invention, the object is achieved by arranging a rolling bearing in a bearing point for a camshaft of a hydraulic camshaft adjuster. The rolling bearing is preferably a ball bearing.

The advantages of the invention can be considered in particular to be that mechanical friction losses and undesired noise generation in the combustion engine can be further reduced.

The bearing point according to the invention of the camshaft can particularly advantageously be applied to a vane-type adjuster with a central supply of pressure medium by means of a control slide. By dispensing with a radial oil guiding duct in the camshaft, the installation space gained can be used for arranging a rolling bearing. The invention may however also be applied to camshaft adjusters with axial oil guiding ducts.

In another advantageous embodiment, the supply of hydraulic oil into the adjuster takes place at the side facing away from the camshaft. In this case, too, an oil guiding duct in the camshaft is not required, and this reduces the axial installation space and nevertheless allows the camshaft to be mounted using rolling bearings.

BRIEF DESCRIPTION OF THE DRAWING

A preferred embodiment of the invention will be explained in more detail below on the basis of the FIGURE, in which:

The FIGURE shows a preferred embodiment of a camshaft adjuster according to the invention in a longitudinal sectional illustration.

DETAILED DESCRIPTION OF THE INVENTION

The FIGURE shows a camshaft adjuster 01. In a known way, the camshaft adjuster is designed as a vane-type adjuster and is arranged in the cylinder head of an internal combustion engine. The camshaft adjuster comprises an outer rotor 02 which is connected to a sprocket 03 for conjoint rotation therewith.

The sprocket 03 is connected via a chain to a crankshaft, and is driven by the latter (not illustrated) during the operation of the internal combustion engine.

The camshaft adjuster 01 also comprises an inner rotor 04 which is connected to a camshaft 06 for conjoint rotation therewith. The fastening of the inner rotor 04 to the camshaft 06 is realized by means of a central screw 07.

Radially aligned vanes 08 which engage one into the other are provided on the outer rotor 02 and on the inner rotor 04, which vanes, in annular sectors, form in each case two pressure chambers 09 for the adjustment in the "early" and "late" directions. For adjustment, depending on the desired adjusting direction, hydraulic oil is pumped into one of the pressure chambers 09, as a result of which a relative rotation between the inner rotor 04 and outer rotor 02, and therefore an adjustment of the phase position of the camshaft 06 relative to the sprocket 03 and therefore relative to the crankshaft, takes place.

In the basic position—typically a "late" control time in the case of inlet valve adjustment and an "early" control time in the case of outlet valve adjustment—a locking element (not illustrated) locks the adjuster when the engine is shut down. During operation, said locking action is released hydraulically.

A control slide 11 is arranged in the central screw 07, coaxially with the longitudinal axis thereof. The control slide 11 can be moved axially by means of an actuating drive 12. The actuating drive 12 is preferably an actuating magnet which moves an armature 13.

The control slide 11, with its annular ducts 14 and with radial bores 16 in the central screw 07, forms a multi-way valve by means of which the flow of the hydraulic oil to one or the other pressure chamber 09 is controlled and an adjustment is thereby realized.

In the event of an axial movement of the control slide 11, therefore, the oil pressure is switched between the pressure chambers 09. The pressure chamber 09 in each case not charged with oil pressure is connected to the return line.

Ducts 17 are provided in the inner rotor 04, which ducts permit the flow of hydraulic oil from a radial duct 18 of the camshaft 06 via an axial duct 19 to the pressure chambers 09 via the control slide 11.

To fix a control time position, the control slide 11 is held by the force of a spring 21 in a basic position, in which the connections of all the ducts are separated from one another.

According to the invention, a rolling bearing 22 is preferably arranged adjacent to the radial duct 18 in the camshaft bearing point 23 of the cylinder head.

In another embodiment of the invention, the supply of hydraulic oil may take place via an axial duct in the camshaft 06. In this way, further installation space can be saved in the axial direction and the camshaft can nevertheless be mounted using rolling bearings.

The mounting, according to the invention, of the camshaft in a rolling bearing at the adjuster side may also be applied to other camshaft adjusters if the axial installation space is available.

LIST OF REFERENCE NUMERALS

01 Camshaft adjuster
02 Outer rotor
03 Sprocket
04 Inner rotor
05 -
06 Camshaft
07 Central screw
08 Vane
09 Pressure chamber
10 -
11 Control slide
12 Actuating drive
13 Armature
14 Annular duct
15 -
16 Radial bore
17 Duct
18 Radial duct
19 Axial duct
20 -
21 Spring

The invention claimed is:

1. A camshaft adjuster assembly comprising:

a camshaft supportable at a bearing point of a support along a length of the camshaft;

a camshaft adjuster for adjusting a phase position of the camshaft relative to a crankshaft, the camshaft adjuster having a first part connectable to the crankshaft and a second part connected to an end of the camshaft; and a rolling bearing for mounting the camshaft at the bearing point, the rolling bearing including an axial side facing the camshaft adjuster, wherein the first part is adjustable relative to the second part by a hydraulic pressure medium to adjust the phase position of the camshaft, and wherein the camshaft has a radial duct formed disposed adjacent to the roller bearing and between the axial side of the roller bearing and the end of the camshaft in an axial direction, and the hydraulic pressure medium is supplied to the camshaft adjuster via the radial duct.

2. The camshaft adjuster assembly as claimed in claim 1, wherein the rolling bearing is a ball bearing.

3. The camshaft adjuster assembly as claimed in claim 1, further comprising a central control slide and a hydraulic pressure medium supply, the radial duct being in fluid communication with the hydraulic pressure medium supply, and the control slide and the radial duct being in communication so as to conduct the hydraulic pressure medium for the phase position adjustment of the camshaft.

4. The camshaft adjuster assembly as claimed in claim 3, further comprising a central screw extending axially into the camshaft, the first part including an inner rotor surrounding an outer surface of the central control slide, the inner rotor including inner rotor ducts formed therein in hydraulic communication with the radial duct.

5. The camshaft adjuster assembly as claimed in claim 4, wherein the camshaft includes an inner surface, the inner rotor includes an inner surface and the central screw includes an outer surface, the inner surface of the camshaft, the inner surface of the inner rotor and the outer surface of the central screw forming an axial duct, the axial duct hydraulically coupling the inner rotor ducts to the radial duct.

6. The camshaft adjuster assembly as claimed in claim 5, further comprising radially aligned vanes, the second part including an outer rotor, the radially aligned vanes being radially between the inner rotor and the outer rotor.

7. The camshaft adjuster assembly as claimed in claim 5, wherein the central control slide is arranged in the central screw coaxially with a longitudinal axis thereof.

8. The camshaft adjuster assembly as claimed in claim 7, wherein the control slide includes annular ducts formed therein and the central screw includes radial bores formed therein, the control slide and the central screw being arranged such that the hydraulic pressure medium from the radial duct flows through the radial bores in the central screw into the annular ducts in the control slide.

9. The camshaft adjuster assembly as claimed in claim 8, wherein the control slide, the central screw, the inner rotor and the camshaft are arranged such that the hydraulic pressure medium from the radial duct flows into the axial duct, from the axial duct into the inner rotor ducts, from the inner rotor ducts into the radial bores, from the radial bores into the annular ducts.

* * * * *